US007390953B2

(12) United States Patent
Jinbo

(10) Patent No.: US 7,390,953 B2
(45) Date of Patent: Jun. 24, 2008

(54) WAVEFORM DATA INTERPOLATION DEVICE AND WAVEFORM DATA INTERPOLATION PROGRAM

(75) Inventor: Teruo Jinbo, Fussa (JP)

(73) Assignee: Casio Computer Co, Ltd., Tokyo (JP)

( * ) Notice: Subject to any disclaimer, the term of this patent is extended or adjusted under 35 U.S.C. 154(b) by 156 days.

(21) Appl. No.: 11/489,129

(22) Filed: Jul. 19, 2006

(65) Prior Publication Data

US 2007/0017348 A1 Jan. 25, 2007

(30) Foreign Application Priority Data

Jul. 19, 2005 (JP) ..... 2005-209244

(51) Int. Cl.
*G10H 7/00* (2006.01)

(52) U.S. Cl. ..... 84/603; 84/604; 700/94

(58) Field of Classification Search ..... 84/603–607; 700/94

See application file for complete search history.

(56) References Cited

U.S. PATENT DOCUMENTS

| | | | | |
|---|---|---|---|---|
| 4,611,522 | A * | 9/1986 | Hideo | 84/607 |
| 4,691,608 | A * | 9/1987 | Sasaki et al. | 84/603 |
| 4,715,257 | A * | 12/1987 | Hoshiai et al. | 84/603 |
| 5,245,126 | A * | 9/1993 | Saito et al. | 84/604 |
| 5,252,773 | A * | 10/1993 | Kozuki et al. | 84/607 |
| 5,432,293 | A * | 7/1995 | Nonaka et al. | 84/607 |
| 5,532,424 | A * | 7/1996 | Hideo | 84/607 |
| 5,644,098 | A * | 7/1997 | Jenkins et al. | 84/624 |
| 5,665,929 | A * | 9/1997 | Dong et al. | 84/624 |
| 5,689,079 | A * | 11/1997 | Kosugi | 84/603 |
| 5,763,800 | A * | 6/1998 | Rossum et al. | 84/603 |
| 5,814,750 | A * | 9/1998 | Wang et al. | 84/602 |
| 5,925,841 | A * | 7/1999 | Rossum | 84/603 |
| 6,138,224 | A * | 10/2000 | Lisle | 711/206 |
| 6,365,816 | B1 * | 4/2002 | Rossum | 84/603 |
| 6,587,514 | B1 * | 7/2003 | Wright et al. | 375/296 |
| 6,992,245 | B2 * | 1/2006 | Kenmochi et al. | 84/622 |
| 7,038,119 | B2 * | 5/2006 | Petef | 84/604 |
| 2002/0008578 | A1 * | 1/2002 | Wright et al. | 330/149 |
| 2002/0044014 | A1 * | 4/2002 | Wright et al. | 330/2 |
| 2002/0171574 | A1 * | 11/2002 | Koyanagi | 341/144 |
| 2002/0194976 | A1 * | 12/2002 | Rossum | 84/1 |
| 2005/0143981 | A1 * | 6/2005 | Koyanagi | 704/211 |

FOREIGN PATENT DOCUMENTS

JP 3223280 B2 8/2001

* cited by examiner

*Primary Examiner*—Lincoln Donovan
*Assistant Examiner*—David S. Warren
(74) *Attorney, Agent, or Firm*—Frishauf, Holtz, Goodman & Chick, P.C.

(57) ABSTRACT

With a decimal-fraction address representing a position between two continuous sample values and input from a decimal-fraction address calculation block (5-2) assumed as x, a product-sum block (5-5) calculates the value of x(1−x) as the sum of exclusive logical sums by approximating the value of (1−x) with a value obtained by inverting the values of all the bits representing x. With the use of the thusly obtained value, the waveform sample value (the waveform value) at a waveform position designated by the decimal-fraction address x is calculated, and time-divided DCO outputs are generated by using the calculation result and output to an accumulation block (5-6).

8 Claims, 10 Drawing Sheets

FIG. 4A

WHEN DECIMAL-FRACTION ADDRESS IS x, x(1-x) IS CALCULATED THOUGH (1-x) INCLUDES 1 AS ITS LSB IN ADDITION TO INVERTED BITS OF x, (1-x) IS APPROXIMATED BY ONLY INVERTED BITS OFx (a)

TRUE FOR ARBITRARY VALUE y IS y&¯y=0 HENCE, CORRESPONDING MULTIPLICATIONS RESULT IN 0

| | INTEGRAL PORTION | DECIMAL FRACTIONAL PORTION | | | | | | | |
|---|---|---|---|---|---|---|---|---|---|
| | | | | | | | | | a[7]&¯a[1] |
| | | | | | | | | a[7]&¯a[2] | a[6]&¯a[2] |
| | | | | | | | a[7]&¯a[3] | a[6]&¯a[3] | a[5]&¯a[3] |
| | | | | | | a[7]&¯a[4] | a[6]&¯a[4] | a[5]&¯a[4] | 0 |
| | | | | | a[7]&¯a[5] | a[6]&¯a[5] | 0 | a[4]&¯a[5] | a[3]&¯a[5] |
| | | | | a[7]&¯a[6] | 0 | a[5]&¯a[6] | a[4]&¯a[6] | a[3]&¯a[6] | a[2]&¯a[6] |
| | + | | 0 | a[6]&¯a[7] | a[5]&¯a[7] | a[4]&¯a[7] | a[3]&¯a[7] | a[2]&¯a[7] | a[1]&¯a[7] |
| | | 0 | | | | | | | |

(b)

TAKING ADVANTAGE OF y&¯z+¯y&z=y^z FOR ARBITRARY VALUES y AND z, RESULTS OF MULTIPLICATIONS ARE REPLACED WITH EXCLUSIVE LOGICAL SUMS

| | | | | | | | | |
|---|---|---|---|---|---|---|---|---|
| | | | | | | | | a[7]^a[1] |
| | | | | | | | a[7]^a[2] | a[6]^a[2] |
| | | | | | | a[7]^a[3] | a[6]^a[3] | a[5]^a[3] |
| | | | | | a[7]^a[4] | a[6]^a[4] | a[5]^a[4] | |
| | | | | a[7]^a[5] | a[6]^a[5] | | | |
| | + | | 0 | a[7]^a[6] | | | | |
| | | 0 | | | | | | |

FIG. 4B

| | | | | | | | | | |
|---|---|---|---|---|---|---|---|---|---|
| a[7] | a[6] | a[5] | a[4] | a[3] | a[2] | a[1] | a[0] | | |
| a[7]&¯a[0] | a[6]&¯a[0] | a[5]&¯a[0] | a[4]&¯a[0] | a[3]&¯a[0] | a[2]&¯a[0] | a[1]&¯a[0] | | 0 | ¯a[0] |
| a[6]&¯a[1] | a[5]&¯a[1] | a[4]&¯a[1] | a[3]&¯a[1] | a[2]&¯a[1] | 0 | a[0]&¯a[1] | | | ¯a[1] |
| a[5]&¯a[2] | a[4]&¯a[2] | a[3]&¯a[2] | 0 | a[1]&¯a[2] | a[0]&¯a[2] | | | | ¯a[2] |
| a[4]&¯a[3] | 0 | a[2]&¯a[3] | a[1]&¯a[3] | a[0]&¯a[3] | | | | | ¯a[3] |
| a[3]&¯a[4] | a[2]&¯a[4] | a[1]&¯a[4] | a[0]&¯a[4] | | | | | | ¯a[4] |
| a[2]&¯a[5] | a[1]&¯a[5] | a[0]&¯a[5] | | | | | | | ¯a[5] |
| a[1]&¯a[6] | a[0]&¯a[6] | | | | | | | | ¯a[6] |
| a[0]&¯a[7] | | | | | | | | | ¯a[7] |
| a[7]^a[0] | a[6]^a[0] | a[5]^a[0] | a[4]^a[0] | a[3]^a[0] | a[2]^a[0] | a[1]^a[0] | | 0 | |
| a[6]^a[1] | a[5]^a[1] | a[4]^a[1] | a[3]^a[1] | a[2]^a[1] | | | | | |
| a[5]^a[2] | a[4]^a[2] | a[3]^a[2] | | | | | | | |
| a[4]^a[3] | | | | | | | | | |
| | | | | | | | | 0 | |

FIG. 4C (c)

ADDITIONS ARE DONE SEQUENTIALLY FROM TOP
ADDITIONS ARE DONE STAGE BY STAGE
SINCE TWO MOST SIGNIFICANT BITS OF ONE OF VALUES TO BE ADDED ARE 00, NO CARRY IS PRODUCED s0 IS CALCULATED s1 IS CALCULATED s2 IS CALCULATED a * ¯a IS REPRESENTED BY s0, s1, AND s2

| | | | | | | | |
|---|---|---|---|---|---|---|---|
| | | | | | | 0 | 0 |
| | | | | | | a[7]^a[2] | a[7]^a[1] |
| | | + | | | | | |
| | | | | | | s0[8] | s0[7] |
| | | | | 0 | 0 | s0[8] | s0[7] |
| | | | a[7]^a[4] | a[7]^a[3] | a[6]^a[3] | a[6]^a[2] |
| | | | s1[6] | s1[5] | s1[4] | s1[3] |
| | 0 | 0 | s1[6] | s1[5] | s1[4] | s1[3] |
| | a[7]^a[6] | a[7]^a[5] | a[6]^a[5] | a[6]^a[4] | a[5]^a[4] | a[5]^a[3] |
| 0 | s2[6] | s2[5] | s2[4] | s2[3] | s2[2] | s2[1] |
| 0 | s2[6] | s2[5] | s2[4] | s2[3] | s2[2] | s2[1] |

FIG. 4D

| | | | | | | |
|---|---|---|---|---|---|---|
| a[7]^a[0] | a[6]^a[0] | a[5]^a[0] | a[4]^a[0] | a[3]^a[0] | a[2]^a[0] | a[1]^a[0] |
| a[6]^a[1] | a[5]^a[1] | a[4]^a[1] | a[3]^a[1] | a[2]^a[1] | 0 | 0 |
| s0[6] | s0[5] | s0[4] | s0[3] | s0[2] | s0[1] | s0[0] |
| s0[6] | s0[5] | s0[4] | | | | |
| a[5]^a[2] | a[4]^a[2] | a[3]^a[2] | | | | |
| s1[2] | s1[1] | s1[0] | | | | |
| s1[2] | | | | | | |
| a[4]^a[3] | | | | | | |
| s2[0] | | | | | | |
| s2[0] | s1[1] | s1[0] | s0[3] | s0[2] | s0[1] | s0[0] |

WAVEFORM DATA INTERPOLATION DEVICE AND WAVEFORM DATA INTERPOLATION PROGRAM

BACKGROUND OF THE INVENTION

1. Field of the Invention

The present invention relates to a waveform data interpolation device and a waveform data interpolation program for calculating a waveform value at an arbitrary waveform position on waveform data which indicates, as waveform sample values, a plurality of waveform values sampled at different waveform positions.

2. Description of the Related Art

Some music sound production apparatuses such as electronic music instruments, etc. calculate a waveform sample value (a waveform value) of a music sound to be produced, by using waveform data indicating, as waveform sample values, a plurality of waveform values sampled at different waveform positions. Such a music sound production apparatus calculates waveform values other than some sampling points by interpolation, in order to produce music sounds at various pitches based on one piece of waveform data. As the result of calculating waveform values other than the sampling points by interpolation, it is possible to produce a music sound at a pitch assigned to a pressed key on the keyboard, or add acoustic effects such as detuning, vibrato, etc.

FIG. 6 shows a conventional method of calculating waveform values other than the sampling points (waveform values other than the sampling points will hereinafter be referred to as"interpolation values"). This calculation method is called linear interpolation. In linear interpolation, an interpolation value is a value of a point existing on a line that connects waveform sample values of adjoining sampling points. The circles in the drawing indicate the waveform sample values at the sampling points, and the square existing on the line connecting the waveform sample values of the adjoining sampling points indicates the interpolation value.

In linear interpolation as shown in FIG. 6, the medium portion between the waveform sample values is approximated by using a line. However, wave crests are generally not linear but curving. Therefore, there is a problem that an interpolation value calculated by linear interpolation often greatly differs from the actual waveform values. It is the actual circumstance that a high interpolation accuracy is hard to obtain due to this problem and that the music sound to be produced is greatly distorted in many cases. This is remarkable particularly in a case where waveform data includes many components that have a frequency half or lower of the sampling frequency, or in a case where the oversampling ratio at the time of output is high.

Since linear interpolation has the above-described problem, interpolation with a higher interpolation accuracy is practiced. A waveform data interpolation device disclosed in, for example, the publication of Japanese Patent No. 3223280 is raised as one that implements a conventional method of such interpolation. The method of interpolation implemented by this conventional waveform data interpolation device will be specifically explained with reference to FIG. 7. In FIG. 7, the X axis represents time (waveform position), and the Y axis represents waveform value. The X axis represents time in the unit of sampling point.

The interpolation method of the conventional waveform data interpolation device disclosed in the publication of Japanese Patent No. 3223280 is as follows. First, a first curve $Y_1(x)$ is found, which runs on the waveform sample values of two sampling points prior to an arbitrary waveform position on waveform data, and the waveform sample value of one sampling point posterior to that arbitrary waveform position. Next, a second curve $Y_2(x)$ is found, which runs on the waveform sample value of one sampling point prior to that waveform position, and the waveform sample values of two sampling points posterior to that waveform position. Then, a third curve $Y_s(x)$ is found, which runs between $Y_1(x)$ and $Y_2(x)$ (for example, the average of $Y_1(x)$ and $Y_2(x)$). A value on $Y_s(x)$ is calculated as the interpolation value of that waveform position. For this purpose, in FIG. 7, the waveform sample values of the respective sampling points are represented in a coordinate system in which the waveform sample value of the sampling point existing immediately prior to the arbitrary waveform position is moved to the origin. Thus, the waveform sample value of the sampling point prior to the arbitrary position by two points has coordinates $(-1, -d_0)$, the waveform sample value of the sampling point immediately posterior to the arbitrary position has coordinates $(1, d_1)$, and the waveform sample value of the sampling point posterior to the arbitrary position by two points has coordinates $(2, d_2)$.

In FIG. 7, $d_0$ to $d_2$ each represent a value of difference calculated with respect to the waveform sample value of the sampling point on the origin, and $\delta_{-1}$ to $\delta_{+1}$ each represent a value of difference calculated with respect to the waveform sample value of the sampling point that is nearest to each sampling point. Based on this, the respective values of difference $d_0$ to $d_2$ are calculated as follows, on the conditions that the waveform sample value of the sampling point prior by two points is indicated as $L_{-1}$, the waveform sample value of the sampling point on the origin is indicated as $L_0$, the waveform sample value of the sampling point immediately posterior is indicated as $L_{+1}$, and the waveform sample value of the sampling point posterior by two points is indicated as $L_{+2}$.

$$d_2=L_{+2}-L_0$$

$$d_1=L_{+1}-L_0$$

$$d_0=L_0-L_{-1} \tag{1}$$

Further, the respective values of difference $\delta_{-1}$ to $\delta_{+1}$ can be calculated as follows.

$$\delta_{+1}=L_{+2}-L_{+1}$$

$$\delta_0=L_{+1}-L_0$$

$$\delta_{-1}=L_0-L_{-1} \tag{2}$$

The conventional waveform data interpolation device disclosed in the publication of Japanese Patent No. 3223280 realizes a higher interpolation accuracy by performing the above-described interpolation. However, due to the interpolation in this manner, the device requires more calculations than required in linear interpolation.

Calculations for interpolation can be done not only by software processing, but by hardware. As the amount of calculations grows, a heavier load is put on the hardware, not only in the case where the calculations are done by hardware processing, but also in the case where the calculations are done by software processing. Thus, in order that processes with a heavier load can be done properly, it is necessary to prepare a processing device with a higher performance, or prepare a processing device limited to this purpose only. Therefore, it is desired that the amount of calculations be reduced as much as possible.

It is common that the hardware for performing calculations for interpolation will have a more complex structure and be larger-scaled as the amount of calculations increases. These accompanying situations both increase the manufacturing costs. Thus, it is desirable that the amount of calculations be reduced also in the case where the calculations are done by hardware.

SUMMARY OF THE INVENTION

The object of the present invention is to provide a waveform data interpolation device which performs interpolation with a high interpolation accuracy, by a less amount of calculations than that in a conventional calculation method.

To achieve the above object, a waveform data interpolation device according to a first aspect of the present invention is intended for calculating a waveform value at an arbitrary waveform position on waveform data which indicates, as waveform sample values, a plurality of waveform values sampled at different waveform positions, and comprises:

a computing unit which approximates a difference obtained by subtracting a positive decimal fractional value from 1 with a value obtained by inverting all bits of the positive decimal fractional value, thereby to derive a result of multiplication between the positive decimal fractional value and the difference; and an interpolation unit which calculates, as a waveform sample value of the arbitrary waveform position on the waveform data, a value on a third curve running between a first curve which runs on waveform sample values of two sampling points prior to the arbitrary waveform position and a waveform sample value of one sampling point posterior to the arbitrary waveform position and a second curve which runs on the waveform sample value of one sampling point prior to the arbitrary waveform position and waveform sample values of two sampling points posterior to the arbitrary waveform position, by using the computing unit.

It is preferred that the computing unit derive the result of multiplication by calculating exclusive logical sums and adding the calculated exclusive logical sums. The interpolation unit may input a value obtained by cutting off a predetermined number of least significant bits representing the positive decimal fractional value to the computing unit as the positive decimal fractional value.

The first curve and the second curve may be both quadratic curves, and the third curve may be the average of the first curve and the second curve.

To achieve the above object, an electronic music instrument according to a second aspect of the present invention comprises the waveform data interpolation device described above.

To achieve the above object, a computer-readable recording medium according to a third aspect of the present invention is a computer-readable recording medium which stores a program to be applied to a computer for calculating a waveform value at an arbitrary waveform position on waveform data which indicates, as waveform sample values, a plurality of waveform values sampled at different waveform positions, and the program is a waveform data interpolation program for executing:

a computing procedure for approximating a difference obtained by subtracting a positive decimal fractional value from 1 with a value obtained by inverting all bits of the positive decimal fractional value, thereby to derive a result of multiplication between the positive decimal fractional value and the difference; and an interpolating procedure for calculating, as a waveform sample value of the arbitrary waveform position on the waveform data, a value on a third curve running between a first curve which runs on waveform sample values of two sampling points prior to the arbitrary waveform position and a waveform sample value of one sampling point posterior to the arbitrary waveform position and a second curve which runs on the waveform sample value of one sampling point prior to the arbitrary waveform position and waveform sample values of two sampling points posterior to the arbitrary waveform position, by using the computing procedure.

It is preferred that the computing procedure derive the result of multiplication by calculating exclusive logical sums and adding the calculated exclusive logical sums. The interpolating procedure may input a value obtained by cutting off a predetermined number of least significant bits representing the positive decimal fractional value to the computing procedure as the positive decimal fractional value.

BRIEF DESCRIPTION OF THE DRAWINGS

These objects and other objects and advantages of the present invention will become more apparent upon reading of the following detailed description and the accompanying drawings in which:

FIGS. 4A to 4D are combined to make one drawing. To combine them, FIG. 4A is placed at the upper left, FIG. 4B at the upper right, FIG. 4C at the lower left, and FIG. 4D at the lower right. The drawing shows diagrams for explaining a calculation method employed for performing interpolation;

DETAILED DESCRIPTION OF THE PREFERRED EMBODIMENTS

Embodiments of the present invention will be specifically explained below with reference to the drawings.

<First Embodiment>

Figure 1:
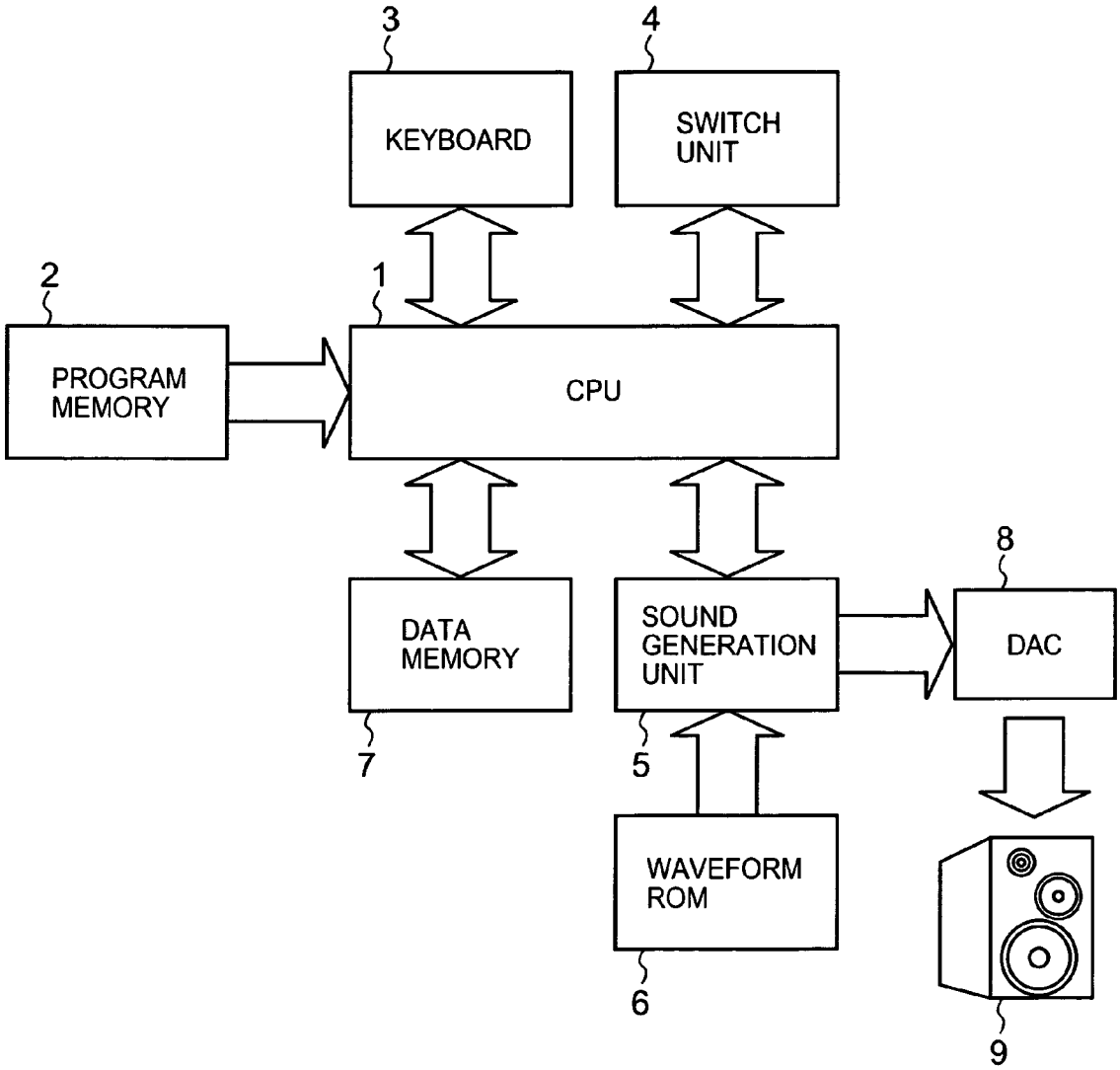
FIG. 1 is a block diagram of an electronic music instrument on which a waveform data interpolation device according to a first embodiment is mounted.

FIG. 1 a block diagram of an electronic music instrument on which a waveform data interpolation device according to the first embodiment is mounted.

As shown in FIG. 1, the electronic music instrument comprises a CPU (Central Processing Unit) 1 which controls the entire instrument, a program memory 2 which stores programs to be executed by the CPU 1, various control data, etc., a keyboard 3 having a plurality of keys, a switch unit 4 having various switches, a sound generation unit 5 which generates a waveform value of a music sound to be produced, a waveform ROM (Read-Only Memory) 6 which stores waveform data for the purpose of waveform value generation, a data memory 7 used by the CPU 1 for its work, a D/A (Digital-to-Analog) converter (DAC) 8 which D/A converts a waveform value output from the sound generation unit 5 to output an analog audio signal, and an audio system 9 which converts the audio signal output from the DAC 8 to a sound and emits the sound. The waveform data interpolation device according to the present embodiment is mounted on the sound generation unit 5.

The CPU 1 controls the entire instrument by executing the program stored in the program memory 2. By executing the program, the CPU 1 scans, for example, the keyboard 3 and the switch unit 4 at predetermined timings respectively. By the scanning, the CPU 1 detects the status of each key on the keyboard 3 and each switch of the switch unit 4. The CPU 1 compares the detection result with a former detection result, and thereby specifies any key or switch having changed its status and the content of the change. As a result, in a case where any key is specified that has changed its status, the CPU 1 gives an instruction to the sound generation unit 5 in accordance with the specified key or switch and the content of the change. By giving that instruction, the electronic music instrument emits a music sound in response to the user's play on the keyboard 3.

The waveform data stored in the waveform ROM 6 indicates a plurality of waveform values sampled at different waveform positions, as waveform sample values. Here, data in which each sampling point has a value of difference δ with respect to the waveform sample value immediately prior to the sampling point itself, is assumed as the waveform data. The respective values of difference δ are stored at different addresses in their orders. The CPU 1 first determines an address width (stepping width; hereinafter referred to as"reading pitch Δ") that corresponds to the pitch of a music sound to be produced. Next, the CPU 1 accesses data at the above-described addresses in the waveform ROM 6 at each that address width to read out the values of difference δ. After this, according to the present embodiment, the CPU 1 controls the waveform data interpolation device mounted on the sound generation unit 5 to generate (calculate) an interpolation value.

Figure 2:
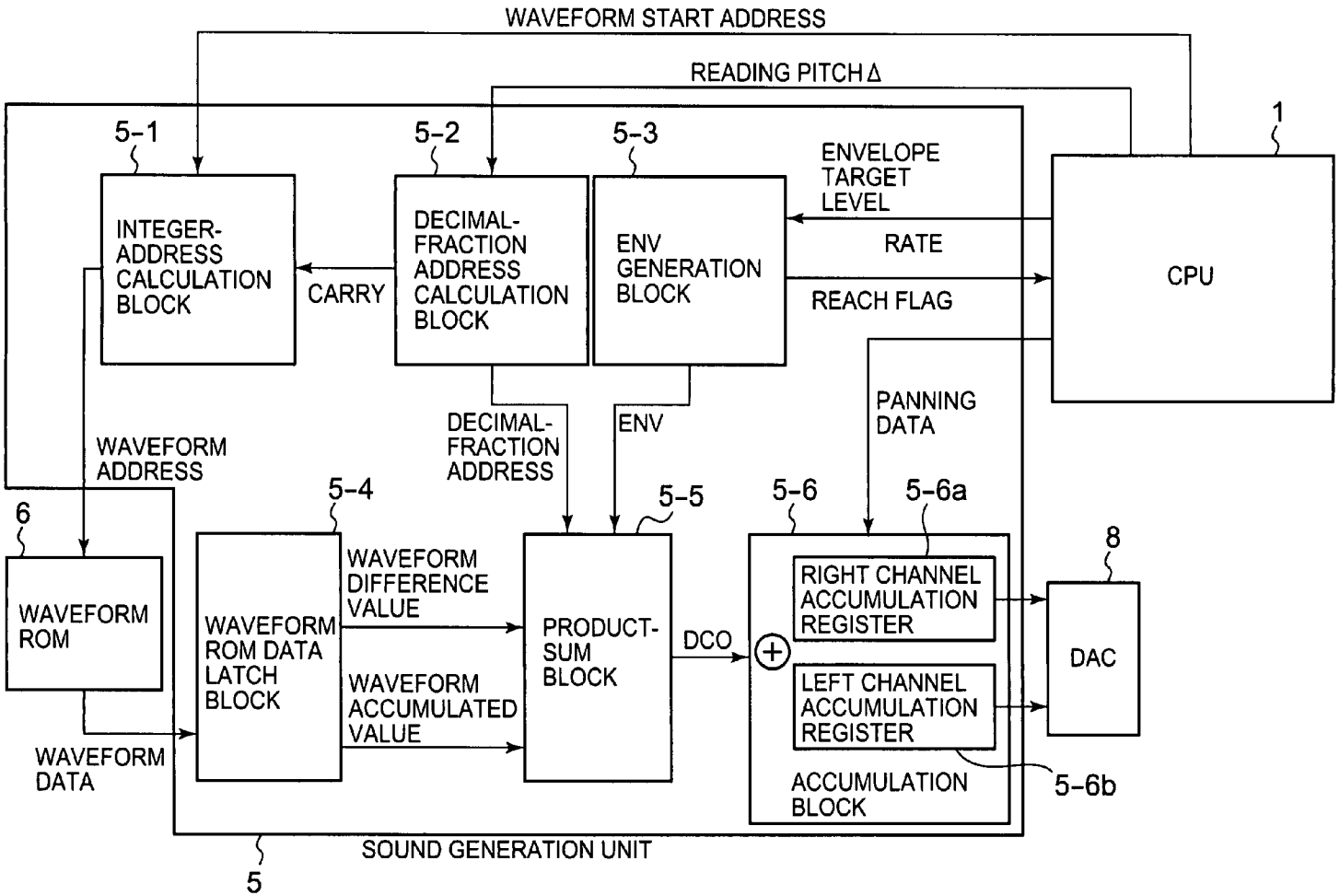
FIG. 2 is a diagram for explaining the structure of a sound generation unit 5.

FIG. 2 is a diagram for explaining the structure of the sound generation unit 5. With reference to FIG. 2, the structure of the sound generation unit 5 will be specifically explained.

In a case where a music sound to be produced occurs in response to a key being pressed on the keyboard 3, the CPU 1 outputs the value of the address (waveform start address) at which reading of the waveform data should be started, and a reading pitch Δ corresponding to the pitch of the music sound, to the sound generation unit 5. Further, in order to control an envelope to be added to the music sound, the CPU 1 outputs an envelope target level and a rate to the sound generation unit 5 if necessary. For example, an envelope target level designates the level of each portion forming the envelope, and a rate designates a time to be used for shifting to a level which should be reached by a next shifting. The form of an envelope to be added to a music sound is determined by the envelope target level and the rate.

The envelope target level and rate are input to an ENV generation block 5-3 of the sound generation unit 5. The ENV generation block 5-3 generates envelope data ENV for adding an envelope determined by these input data to the music sound to be produced, and outputs the generated envelope data ENV to a product-sum block 5-5. When a sustain portion in the envelope to be added is reached, the ENV generation unit 5-3 outputs a reach flag for notifying this to the CPU 1.

The reading pitch Δ is a value including a decimal point. A decimal-fraction address calculation block 5-2 is given the reading pitch Δ from the CPU 1, performs accumulation of the reading pitch Δ sequentially, and outputs the decimal fractional portion of each accumulated value as a decimal-fraction address x to the product-sum block 5-5. In a case where a carry occurs, the decimal-fraction address calculation block 5-2 outputs the carry to an integer-address calculation block 5-1.

The integer-address calculation block 5-1 receives the waveform start address from the CPU 1. Also, the integer-address calculation block 5-1 receives a waveform loop address from the waveform ROM 6. The waveform loop address indicates the range in which waveform data is repeatedly read out. The initial value of an integer address is the waveform start address (or the value thereof). The integer address is incremented each time the integer-address calculation block 5-1 receives a carry from the decimal-fraction address calculation block 5-2. When the integer address obtained after an increment exceeds the range in which the waveform data is repeatedly read out, the value is returned to the head value of the range. This makes it possible to calculate a waveform value irrespective of the length of an emission period of the music sound.

A waveform ROM data latch block 5-4 acquires a value of difference δ read out from the waveform ROM 6 based on the integer address calculated by the integer-address calculation block 5-1, performs accumulation, subtraction, etc. on the acquired value of difference δ, and sends a waveform accumulated value (waveform sample value of a sampling point) obtained by the accumulation and a waveform difference value obtained by the subtraction to the product-sum block 5-5.

Figure 7:
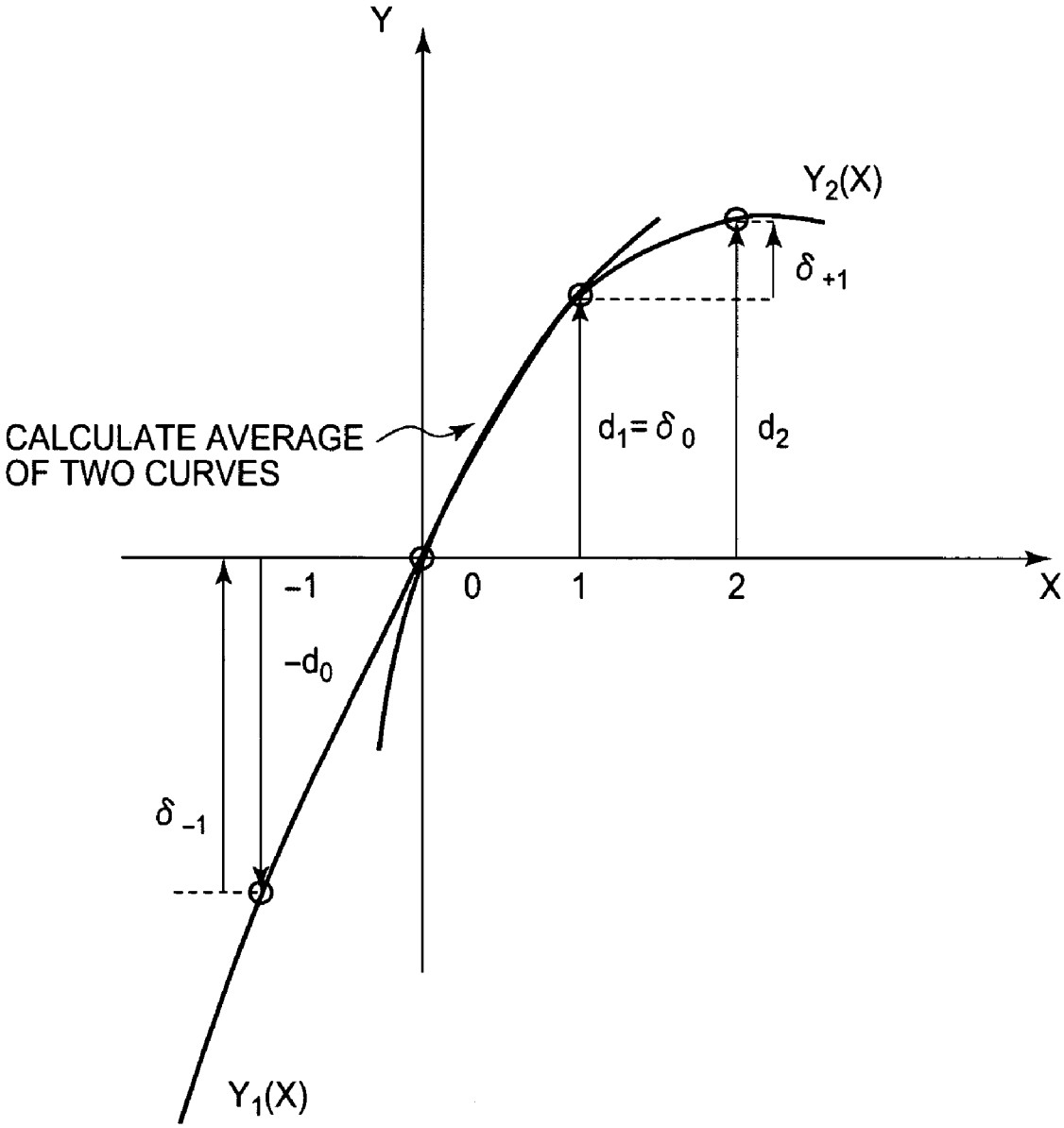
FIG. 7 is a diagram for explaining conventional interpolation.

The product-sum block 5-5 calculates an interpolation value by the method shown in FIG. 7, by using the waveform difference values and waveform accumulation values sent from the waveform ROM data latch block 5-4 and the decimal-fraction addresses x sent from the decimal-fraction address calculation block 5-2. Then, the product-sum block 5-5 outputs the result of multiplying the interpolation value by the envelope data ENV to an accumulation block 5-6 over plural times corresponding to the number of DCOs (Digitally-Controlled Oscillator) as sound sources, in accordance with a time-division method. The accumulation block 5-6 assigns the output from each DCO to a RIGHT channel accumulation register **5-6*a* or to a LEFT channel accumulation register 5-6*b* in accordance with panning data output from the CPU 1 to accumulate the outputs. As a result, accumulated values of the waveform values of the music sound to be produced through the corresponding channels are stored in the accumulation registers 5-6*a* and 5-6*b*, respectively. By these accumulated values being output to the DAC 8** respectively, music sounds are emitted through the RIGHT and LEFT channels respectively.

The decimal-fraction addresses x mentioned above indicate waveform positions at which interpolation values should be calculated. Assume that a decimal-fraction address x is given. A quadratic curve that runs on two sampling points prior to the waveform position x and one sampling point posterior to the waveform position x is assumed to be $Y_1(x)$. A quadratic curve that runs on one sampling point prior to the waveform position x and two sampling points posterior to the waveform position x is assumed to be $Y_2(x)$. The average of $Y_1(x)$ and $Y_2(x)$ is assumed to be $Y_s(x)$. The question to be considered below is how the curve $Y_s(x)$ will be expressed by the waveform values (waveform sample values) of the sampling points or their values of difference δ. Hereafter, the explanation will be given with reference to FIG. 7.

In the coordinate system shown in FIG. 7, the waveform sample value of the sampling point positioned immediately prior to the decimal-fraction address x is moved to the origin. On the assumptions that the waveform sample value of the sampling point at the origin is represented as $L_0$, the waveform sample value of the sampling point prior to this sampling point is represented as $L_{-1}$, the waveform sample value of the sampling point posterior to the origin is represented as $L_{+1}$, and the waveform sample value of the sampling point posterior to this sampling point is represented as $L_{+2}$, $d_0$ to $d_2$ and $\delta_{-1}$ to $\delta_{+1}$ in FIG. 7 are expressed by the foregoing equations (1) and expressions (2).

Assume that the quadratic curve $Y_2(x)$ that runs on the origin, (1, $d_1$), and (2, $d_2$) is represented as $Y_2(x)=ax^2+bx$.

In case of x=1, the calculation results as follows.

$$Y_2(x)=d_1=a+b \tag{3}$$

In case of x=2, the calculation results as follows.

$$Y_2(x)=d_2=4a+2b \tag{4}$$

The calculation of equation (4)−equation (3)×2 results as follows.

$$2a=d_2-2d_1 \therefore a=(1/2)(d_2-2d_1) \tag{5}$$

Further, the calculation of equation (3)×4−equation (4) results as follows.

$$2b=4d_1-d_2 \therefore b=(1/2)(4d_1-d_2) \tag{6}$$

Therefore, when a and b represented by the equations (5) and (6) are substituted for a and b in the equation $Y_2(x)=ax^2+bx$, the following equation is obtained.

$$Y_2(x)=(1/2)(d_2-2d_1)x^2+(1/2)(4d_1-d_2)x \tag{7}$$

Likewise, assume that the quadratic curve $Y_1(x)$ that runs on (−1, $-d_0$), the origin, and (1, $d_1$) is represented as $Y_1(x)=ax^2+bx$.

In case of x=−1, the calculation results as follows.

$$Y_1(x)=-d_0=a-b \tag{8}$$

In case of x=1, the calculation results as follows.

$$Y_1(x)=d_1=a+b \tag{9}$$

The calculation of −equation (8)+equation (9) results as follows.

$$2a=d_1-d_0 \therefore a=(1/2)(d_1-d_0) \tag{10}$$

Further, the calculation of −equation (8)+equation (9) results as follows.

$$2b=d_1+d_0 \therefore b=(1/2)(d_1+d_0) \tag{11}$$

Therefore, when a and b represented by the equations (10) and (11) are substituted for a and b in the equation $Y_1(x)=ax^2+bx$, the following equation is obtained.

$$Y_1(x)=(1/2)(d_1-d_0)x^2+(1/2)(d_1+d_0)x \tag{12}$$

When the actual waveform value $L_0$ of the origin is added to the equations (7) and (12) in order to get the coordinate system back to its original, the results are as follows.

$$Y_2(x)=(1/2)(d_2-2d_1)x^2+(1/2)(4d_1-d_2)x+L_0 \tag{13}$$

$$Y_1(x)=(1/2)(d_1-d_0)x^2+(1/2)(d_1+d_0)x+L_0 \tag{14}$$

When the average of the quadratic curves $Y_1(x)$ and $Y_2(x)$ is assumed as a curve $Y_s(x)$, it will be as follows.

$$\begin{aligned} Y_S(x) &= 1/2\{Y_1(x)+Y_2(x)\} \\ &= (1/4)(d_2-d_1-d_0)x^2+(1/4)(-d_2+5d_1+d_0)x+L_0 \\ &= (1/4)x\{d_2(x-1)+d_1(-x+5)+d_0(-x+1)\}+L_0 \\ &= (1/4)x\{-d_2(1-x)+d_1(1-x)+ \\ &\quad d_0(1-x)+4d_1\}+L_0 \\ &= x\{(1/4)(-d_2+d_1+d_0)(1-x)+d_1\}+L_0 \end{aligned} \tag{15}$$

Since $d_0$ to $d_2$ and $L_{-1}$ to $L_{+2}$ are in the relationship represented by the equations (1), $(-d_2+d_1+d_0)$ in the equation (15) is calculated by the following.

$$\begin{aligned} (-d_2+d_1+d_0) &= -(L_{+2}-L_0)+(L_{+1}-L_0)+(L_0-L_{-1}) \\ &= -(L_{+2}-L_{+1})+(L_0-L_{-1}) \end{aligned} \tag{16}$$

Further, when the equation (15) is transformed based on the relationship between $\delta_{-1}$ to $\delta_{+1}$ and $L_{-1}$ to $L_{+2}$ represented by the equations (2) and the equation (16), the following equation will be obtained.

$$Y_s(x)=x*\{(1/4)(-\delta_{+1}+\delta_{-1})*(1-x)+\delta_0\}+L_0 \tag{17}$$

In the equation (17), multiplications are done at two positions represented by "*". These multiplications are done in an order that the multiplication within { } is done, the succeeding addition is done, and then the remaining multiplication is done.

It is common in LSI (Large Scale Integration) circuit designing to employ a structure in which signals output from a flip flop (hereinafter referred to as"FF") in synchronization with the same clock signal are passed through a combinational circuit to be input to an FF of the next stage. A multiplier can be constituted by a combinational circuit. However, as the width of the bits to be subjected to calculation becomes larger, the path of the multiplier tends to be a longer one along which many gates (elementary elements) have to be passed.

Such a path can be divided into a plurality of shorter paths by adding an FF or the like in the combinational circuit constituting the multiplier. For example, by inserting a single-stage FF for holding an intermediate result of the multiplier, it is possible to divide the path into a plurality of shorter paths. Since the insertion of the FF will make the outputting of a result take a period of 1 clock both before and after the FF, it will take the multiplier a period of 2 clocks to output its multiplication result. However, since such a combinational circuit can perform different multiplications before and after the FF, two multiplication results can be obtained during two clocks (pipeline calculation), if the multiplications are done continuously. In a case where FFs are inserted for two or more stages, it is as well possible to obtain one multiplication result per one clock.

In the above-described equation (17), it is necessary to treat the result of the first multiplication as the input value to be used for the next multiplication. In order to realize such a high utilization efficiency of a multiplier as described above, it is necessary not to spoil the calculation result obtained at each stage. Thus, in performing the multiplications in the equation (17), scheduling for making the multiplication using the result of the former multiplication to be performed will be complicated. In order to avoid this, according to the present embodiment, the equation (17) is transformed as follows.

$$Y_s(x)=(1/4)(-\delta_{+1}+\delta_{-1})*x(1-x)+\delta_0*x+L_0 \tag{18}$$

According to the present embodiment, x(1−x) in the equation (18) is performed by a dedicated multiplier (hardware). Therefore, in the equation (18), multiplications are done at two positions represented by "*", namely, $(-\delta_{+1}+\delta_{-1})*x(1-x)$ and $\delta_0*x$. It should be noted that since these multiplications at the two positions are not such that the result of one multiplication is used for the other multiplication, they have no calculative relationship. Hence, the calculation of the entire equation (18) can be performed with a simple scheduling.

Since x indicates the waveform position to be interpolated, it satisfies $1>x\geqq 0$. Since it is obvious that $x\geqq 0$, i.e., x does not take a minus value, no bit is required for representing the plus or minus symbol in representing x by a binary value. Further, since x<1, all the bits can be used only for representing numbers at decimal places in representing x by a binary value. In this case, in order to calculate (1−x), it is, strictly speaking, necessary to add 1 as the lsb (least significant bit) after the values of all the bits representing x are inverted. As compared with this, according to the present embodiment, the following approximation is used for calculating (1−x). That is, inversion of the values of all the bits representing x is only done, and addition of 1 as the lsb is omitted. By using this approximation, it is possible to calculate x(1−x) as follows. A specific explanation will be given with reference to FIGS. 4A to 4D. The combination of FIGS. 4A to 4D shows the process of calculating x(1−x). In FIGS. 4A to 4D, x is represented as a decimal fractional value by using 8 bits, with the bits expressed as a[7] to a[0] respectively. The approximation of (1−x) obtained by inverting the values of all the bits representing x is represented by expressing its respective bits as ¯a[7] to ¯a[0] (though a superior symbol "~" is usually used as a bit inversion symbol, here, a superior symbol "¯" is used as such a symbol). a[0] and ¯a[0] represent the value of the lsb. "&" represents a logical product, and "^" represents an exclusive logical sum. Note that a[7] to a[0] are also represented as "a[7:0]". This applies to other similar cases.

For obtaining the value of x(1−x) by using direct multiplication between x and (1−x), calculations as shown in (a) of FIGS. 4A to 4B have to be done. In (a) of FIGS. 4A to 4B, regarding an arbitrary value y, it is true that y&¯y=0. Therefore, the following is true.

$$a[0]\&\bar{a}[0]=a[1]\&\bar{a}[1]=\ldots=a[7]\&\bar{a}[7]=0$$

Further, regarding arbitrary values y and z, it is true that y&¯z+¯y&z=y^z. Thus, the sum of the products of values at two positions which are in a line symmetry relationship with respect to a line that connects zeros (0) in (a) of FIGS. 4A to 4B can be represented by using an exclusive logical sum. Specifically, this will be as follows.

$$a[1]\&\bar{a}[0]+a[0]\&\bar{a}[1]=a[1]\hat{}a[0]$$

$$a[2]\&\bar{a}[0]+a[0]\&\bar{a}[2]=a[2]\hat{}a[0]$$

$$a[3]\&\bar{a}[0]+a[0]\&\bar{a}[3]=a[3]\hat{}a[0]$$

$$a[2]\&\bar{a}[1]+a[1]\&\bar{a}[2]=a[2]\hat{}a[1]$$

$$a[7]\&\bar{a}[6]+a[6]\&\bar{a}[7]=a[7]\hat{}a[6]$$

This enables x(1−x) to be calculated as the sum of the exclusive logical sums of the respective bits, as shown in (b) of FIGS. 4A to 4B. This sum is calculated by a calculation method shown in (c) of FIGS. 4C and 4D.

As shown in (c) of FIGS. 4C and 4D, the sum of the exclusive logical sums is calculated by additions over three stages. In (c) of FIGS. 4C and 4D, s2[6:0], s1[6:0], and s0[8:0] each represent the result of addition at the corresponding stage for the corresponding bits.

According to the present embodiment, it is arranged that no carry be produced at each stage, since the two msbs (most significant bits) included in one of the two values to be added at each stage are"0 0". Thus, as shown at the lowermost row in (c) of FIGS. 4C and 4D, the sum of the exclusive logical sums becomes a value represented by the total of 15 bits (including 0, 0, s2[6:0], s1[1:0], s0[3:0]).

By taking the approximation of one of x and (1−x) obtained by inverting the values of all the bits of the other in the above-described manner, it is possible to obtain the result of x(1−x) in the form of the sum of the exclusive logical sums. The number of combinations between the bits to be the objective of calculations is greatly reduced. Therefore, it is possible to greatly reduce the amount of calculations, as obvious from (a) and (c) of FIGS. 4A to 4D. Therefore, in a case where the calculations are to be performed by hardware, smaller-sized hardware will suffice for the calculations to be performed at a high speed. Further, hardware control will be more simplified. In a case where the calculations are to be performed by software processing, the calculations can be done at a higher speed by modifying the software. From these matters, it can be said that a waveform data interpolation device can be realized at a lower cost in any of the cases where the calculations for interpolation are done by hardware and done by software.

Figure 3:
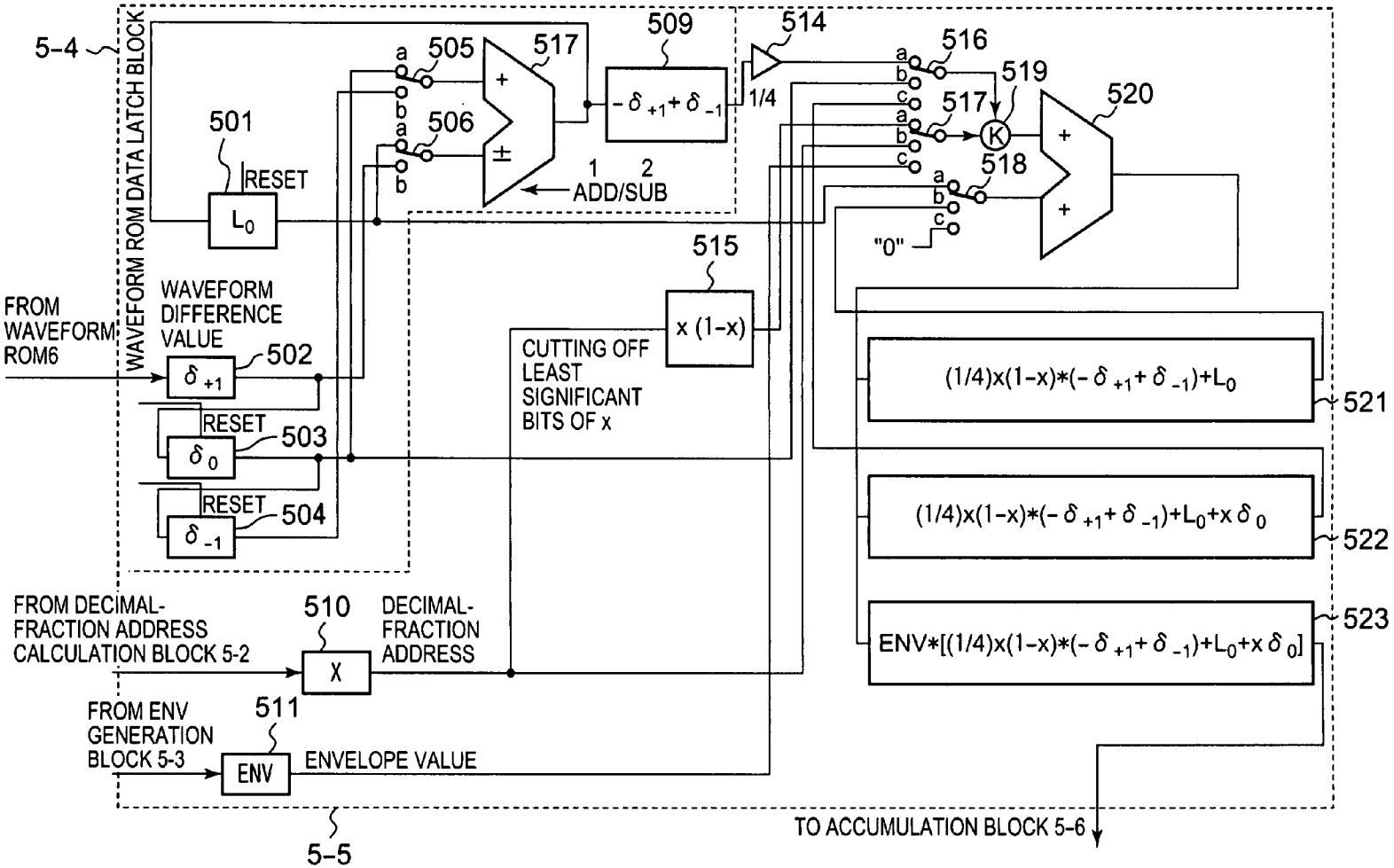
FIG. 3 is a diagram for explaining the structures of a waveform ROM data latch block 5-4 and product-sum block 5-5 of the sound generation unit 5.

The calculations for obtaining the sum of the exclusive logical sums are performed by the waveform ROM data latch block 5-4 and the product-sum block 5-5 in the sound generation unit 5. Thus, the structures and operations of these blocks 5-4 and 5-5 will be specifically explained with reference to FIG. 3. In FIG. 3, the reference numerals 501 to 504, 509 to 511, and 521 to 523 represent registers, the reference numerals 505, 506, 516, 517, and 518 represent multiplexers, the reference numeral 507 represents an adder-subtractor, the reference numeral 514 represents a right 2-bit shifter, the reference numeral 515 represents a computing unit as the hardware for calculating x(1−x), the reference numeral 519 represents a multiplier, and the reference numeral 520 represents an adder.

To begin with, the operation of the waveform ROM data latch block 5-4 will be specifically explained.

The register 501 stores the waveform value $L_0$ at the sampling point at the origin in the coordinate system shown in FIG. 7, and the registers 503, 502, and 504 store the value of difference $\delta_0$ of that sampling point, the value of difference $\delta_{+1}$ of the sampling point immediately posterior to that sampling point, and the value of difference $\delta_{-1}$ of the sampling point positioned immediately prior to the sampling point at the origin, respectively. When the waveform ROM data latch block 5-4 is to read out a new value of difference δ from the waveform ROM 6, the read-out value of difference δ is stored in the register 502. The values of difference δ having been stored in the registers 502 and 503 by that time are stored in the registers 503 and 504 before the newly read-out value is stored. Before the values in the registers 503 and 504 are updated, the multiplexers 505 and 506 are caused to select their terminals"a" to instruct the adder-subtractor 507 to perform addition (ADD). By this addition, $\delta_0+L_0=L_1-L_0+L_0=L_1$ is calculated, and the result of the calculation is stored in the register 501 as a new waveform value $L_0$.

After the value of difference δ is stored in the register 502, the multiplexers 505 and 506 are caused to select their terminals "b" to instruct the adder-subtractor 507 to perform subtraction (SUB). By this subtraction, the result of a calculation $-\delta_{+1}+\delta_{-1}$ is stored in the register 509.

These operations are performed in response to the reading of a new value of difference δ from the waveform ROM 6. The contents stored in the registers 501, 503 and 504 are reset in response to a reset signal when new waveform data is assigned. Such a reset signal will be output by, for example, the CPU 1, or in accordance with an instruction therefrom.

Next, the operation of the product-sum block 5-5 will be specifically explained.

The registers 510 and 511 store the latest decimal-fraction address x output from the decimal-fraction address calculation block 5-2, and the latest envelope data (envelope value) ENV output from the ENV generation block 5-3, respectively. The computing unit 515 is the hardware for calculating the sum of exclusive logical sums, which derives the value of x(1−x) by the calculation method shown in (c) of FIGS. 4C and 4D. The calculation of this value is performed when, for example, a new decimal-fraction address x is stored in the register 510.

When the computing unit 515 calculates the value of x(1−x), the multiplexers 516, 517, and 518 are caused to select their terminals"a" to instruct the multiplier 519 and the adder 520 to perform calculations respectively. As a result, the multiplier 519 outputs the result of multiplication between a value, which is obtained by the value stored in the register 509 being reduced to its ¼ after subjected to rightward 2-bit shifting by the right 2-bit shifter 514 (the thusly obtained value=$(1/4)(-\delta_{+1}+\delta_{-1})$), and x(1−x). The adder 520 outputs the result of addition between the result of multiplication and the waveform value $L_0$ (the result of addition=$(1/4)x(1-x)*(-\delta_{+1}+\delta_{-1})+L_0$). This result of addition is stored in the register 521.

When the storage of the result of addition in the register 521 is completed, the multiplexers 516, 517, and 518 are next caused to select their terminals"b" to instruct the multiplier 519 and the adder 520 to perform calculations respectively. As a result, the multiplier 519 outputs the result of multiplication between the value of difference $\delta_0$ stored in the register 503 and the decimal-fraction address x. The adder 520 outputs the result of addition between this result of multiplication and the value stored in the register 521 (the result of addition=$(1/4)x(1-x)*(-\delta_{+}+\delta_{-1})+L_0+x\delta_0$). This result of addition is stored in the register 522.

When the storage of the result of addition in the register 522 is completed, the multiplexers 516, 517, and 518 are then caused to select their terminals "c" to instruct the multiplier 519 and the adder 520 to perform calculations respectively. As a result, the multiplier 519 outputs the result of multiplication between the value stored in the register 522 and the envelope value ENV. The adder 520 outputs the result of addition between this result of multiplication and 0 (the result of addition=$ENV*[(1/4)x(1-x)*(-\delta_{+1}+\delta_{-1})+L_0+x\delta_0]$). This result of addition is stored in the register 523 and output to the accumulation block 5-6 as DCO outputs as time-divided.

As described above, according to the structure of the first embodiment, a difference obtained by subtracting a positive decimal fractional value from 1 is approximated by a value obtained by inverting all the bits representing the positive decimal fractional value, and multiplication between the positive decimal fractional value and the difference is performed independently. With the use of the result of the multiplication, a value on a third curve running between a first curve which runs on the waveform sample values of two sampling points prior to an arbitrary waveform position on waveform data and the waveform sample value of one sampling point posterior to the arbitrary waveform position, and a second curve which runs on the waveform sample value of one sampling point prior to the arbitrary waveform position and the waveform sample values of two sampling points posterior to the arbitrary waveform position, is calculated as the waveform sample value of the arbitrary waveform position.

By approximating a difference obtained by subtracting a positive decimal fractional value from 1 with a value obtained by inverting all the bits representing the positive decimal fractional value, it is possible to derive the result of multiplication between the positive decimal fractional value and the difference by, for example, calculating exclusive logical sums and adding the obtained sums. The number of combinations between the bits to be the objective of calculations can be greatly reduced as compared with a case where the difference and the positive decimal fractional value are multiplied. Accordingly, it is possible to greatly reduce the amount of calculations necessary for calculating a value on the third curve as the waveform sample value of the arbitrary waveform position.

<Second Embodiment>

$\delta_0*x+L_0$ in the right-hand side of the equation (18) corresponds to the interpolation value obtained when linear interpolation is performed. The portion except this portion, i.e., $(1/4)(-\delta_{+1}+\delta_{-1})*x(1-x)$ can be seen as a correcting value for the interpolation value that is calculated by using the value of difference $\delta_{-1}$ in a section (between two continuous sampling points) prior to the section used for the linear interpolation and the value of difference $\delta_{+1}$ in a section posterior to the section used for the linear interpolation. The second embodiment seeks calculation of an interpolation value from this point of view.

The structure of an electronic music instrument on which the waveform data interpolation device according to the second embodiment is mounted is basically the same as that of the first embodiment. And the operations are also mostly the same. Thus, only such a part as different from the first embodiment will be explained by using the reference numerals used in the explanation of the first embodiment.

Figure 5:
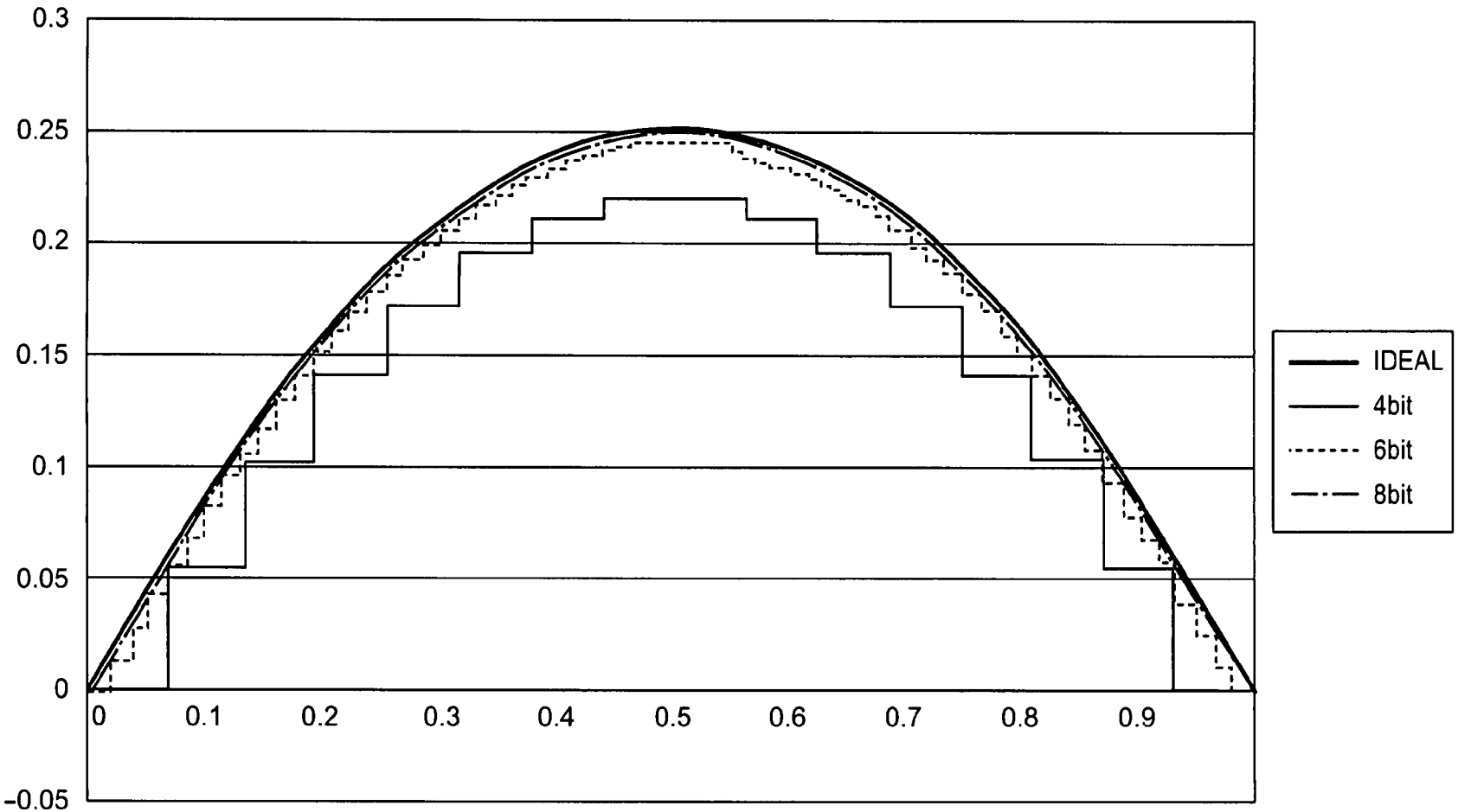
FIG. 5 is a diagram for explaining variations of a correcting value based on bit numbers.
Figure 6:
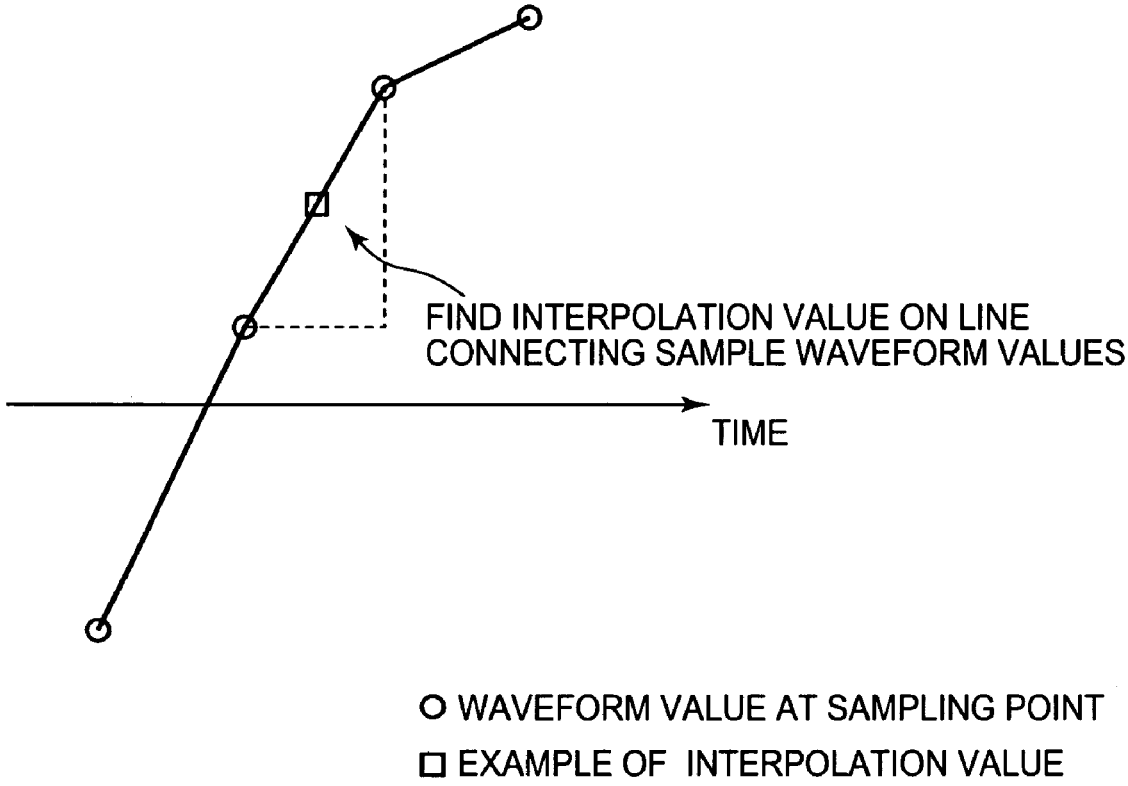
FIG. 6 is a diagram for explaining linear interpolation conventionally implemented.

FIG. 5 is a diagram for explaining variations of the correcting value based on bit numbers. For simplifying the explanation, shown in FIG. 5 is the correcting value at a case where $(1/4)(-\delta_{+1}+\delta_{-1})=1$, i.e., x(1−). The horizontal axis of the graph shown in FIG. 5 represents the value of the decimal-fraction address x, and the vertical axis represents the correcting value. Correcting values of various types in the case where the decimal-fraction address is changed in the range of $1>x\geqq 0$ are represented. In FIG. 5, correcting values obtained in the cases where the number of bits representing the value of the decimal-fraction address x is 4, 6, and 8 bits respectively, i.e., in the cases where the decimal-fraction address x is approximated by values represented by these bit numbers, are shown by a solid line, a dotted line, and a dashed dotted line, respectively, and the ideal value of the correcting value is represented by a bold line.

As shown in FIG. 5, when the decimal-fraction address x is approximated, the correcting values of all the types become smaller than the ideal value (to be more accurate, the values on the vertical axis are closer to 0 than the ideal value is). This means that a correcting value (a waveform value) actually obtained when interpolation is actually performed becomes the median between the waveform value of a case where the interpolation is performed ideally, and the waveform value of a case where linear interpolation is only performed. As the number of bits representing the decimal-fraction address x is greater, the waveform value to be actually obtained becomes closer to the waveform value obtained when the interpolation is performed ideally. However, FIG. 5 indicates that a bit number, which is large to a certain degree, is sufficient to make the correcting value closer to the ideal waveform value.

In FIG. 3, in a case where only the 4 msbs of the decimal-fraction address x stored in the register 510 are input to the computing unit 515 and the bit number of the output from the computing unit 515 is 8 bits, the 2 msbs and lsb of the output become 0 without exception. Therefore, the multiplier 519 needs only to be ready to receive 5 bits at its input.

If the number of bits to be received at the input where the output from the computing unit 515 is received is reduced further, the size of the multiplier to perform multiplication using that output can be reduced further. Therefore, the scale of the hardware for performing calculations for interpolation can also further be reduced. In a case where the calculations are performed by software processing, the memory capacity necessary for the processing can further be reduced.

Since $(-\delta_{+1}+\delta_{-1})*x(1-x)$ in the right-hand side of the equation (18) is multiplied by ¼ as a weighting factor, the accuracy of the output from the computing unit 515 is as precise as 10 bits, with 2 bits of 0 added as the msbs. Even in the case where only the 4 msbs of the decimal-fraction address x are input to the computing unit 515, a sufficiently accurate correcting value can be obtained as shown in FIG. 5. Likewise, in a case where the only n-number of msbs of the decimal-fraction address x are input to the computing unit 515, the accuracy of the output from the computing unit 515 will be 2*n+2 bits, and the receiver of this output needs only to receive 2*n−3 bits. Based on those described above, according to the second embodiment, the decimal-fraction address x stored in the register 510 has only its n-number of msbs input to the computing unit 515, and has its bits less significant than these bits cut off.

According to the embodiments (first embodiment and second embodiment) of the resent invention, the calculations for interpolation are performed by the hardware mounted on the sound generation unit 5. Alternatively, the calculations may be performed by software processing. The structure of the hardware is not limited to those of the embodiments described above, but may be modified in various manners.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2005-209244 filed on Jul. 19, 2005 and including specification, claims, drawings and summary. The disclosure of the above Japanese Patent Application is incorporated herein by reference in its entirety.

What is claimed is:

1. A waveform data interpolation device for calculating a waveform value at an arbitrary waveform position on waveform data which indicates, as waveform sample values, a plurality of waveform values sampled at different waveform positions, the device comprising:

a computing unit which approximates a difference obtained by subtracting a positive decimal fractional value from 1 with a value obtained by inverting all bits of the positive decimal fractional value, thereby to derive a result of multiplication between the positive decimal fractional value and the difference; and an interpolation unit which calculates, as a waveform sample value of the arbitrary waveform position on the waveform data, a value on a third curve running between a first curve which runs on waveform sample values of two sampling points prior to the arbitrary waveform position and a waveform sample value of one sampling point posterior to the arbitrary waveform position and a second curve which runs on the waveform sample value of one sampling point prior to the arbitrary waveform position and waveform sample values of two sampling points posterior to the arbitrary waveform position, by using the computing unit.

2. The waveform data interpolation device according to claim 1, wherein the computing unit derives the result of multiplication by calculating exclusive logical sums and adding the calculated exclusive logical sums.

3. The waveform data interpolation device according to claim 1, wherein the interpolation unit inputs a value obtained by cutting off a predetermined number of least significant bits representing the positive decimal fractional value to the computing unit as the positive decimal fractional value.

4. The waveform data interpolation device according to claim 1, wherein the first curve and the second curve are both quadratic curves, and the third curve is an average of the first curve and the second curve.

5. An electronic music instrument, comprising the waveform data interpolation device according to claim 1.

6. A computer-readable recording medium which stores a program to be applied to a computer for calculating a waveform value at an arbitrary waveform position on waveform data which indicates, as waveform sample values, a plurality of waveform values sampled at different waveform positions, the program being a waveform data interpolation program for executing:

a computing procedure for approximating a difference obtained by subtracting a positive decimal fractional value from 1 with a value obtained by inverting all bits of the positive decimal fractional value, thereby to derive a result of multiplication between the positive decimal fractional value and the difference; and an interpolating procedure for calculating, as a waveform sample value of the arbitrary waveform position on the waveform data, a value on a third curve running between a first curve which runs on waveform sample values of two sampling points prior to the arbitrary waveform position and a waveform sample value of one sampling point posterior to the arbitrary waveform position and a second curve which runs on the waveform sample value of one sampling point prior to the arbitrary waveform position and waveform sample values of two sampling points posterior to the arbitrary waveform position, by using the computing procedure.

7. The computer-readable recording medium according to claim 6, wherein the computing procedure derives the result of multiplication by calculating exclusive logical sums and adding the calculated exclusive logical sums.

8. The computer-readable recording medium according to claim 6, wherein the interpolating procedure inputs a value obtained by cutting off a predetermined number of least significant bits representing the positive decimal fractional value to the computing procedure as the positive decimal fractional value.

* * * * *